US006074187A

United States Patent [19]

Kawada et al.

[11] Patent Number: 6,074,187

[45] Date of Patent: Jun. 13, 2000

[54] COMPRESSOR

[75] Inventors: Minoru Kawada; Mikihiko Ishii, both of Aichi, Japan

[73] Assignee: Mitsubishi Heavy Industries, Ltd., Tokyo, Japan

[21] Appl. No.: 09/196,894

[22] Filed: Nov. 19, 1998

[30] Foreign Application Priority Data

Nov. 20, 1997 [JP] Japan ..... 9-334855

[51] Int. Cl.[7] ..... F01C 1/02

[52] U.S. Cl. ..... 418/55.6; 418/55.1

[58] Field of Search ..... 42/154; 418/55.1, 418/55.6

[56] References Cited

U.S. PATENT DOCUMENTS

| | | | |
|---|---|---|---|
| 4,332,535 | 6/1982 | Terauchi et al. | 418/55.6 |
| 4,340,339 | 7/1982 | Hiraga et al. | 418/55.6 |
| 4,484,869 | 11/1984 | Nakayama et al. | 418/55.6 |
| 4,781,553 | 11/1988 | Nomura et al. . | |

FOREIGN PATENT DOCUMENTS

| | | | |
|---|---|---|---|
| 0 264 005 | 4/1988 | European Pat. Off. . | |
| 0 775 812 | 5/1997 | European Pat. Off. . | |
| 2 393 174 | 12/1978 | France . | |
| 37 09 106 | 9/1988 | Germany . | |
| 57-176382 | 10/1982 | Japan | 418/55.6 |
| 60-135691 | 7/1985 | Japan | 418/55.6 |
| 3-164590 | 7/1991 | Japan | 418/55.6 |
| 07167068 | 12/1993 | Japan . | |

*Primary Examiner*—Hoang Nguyen
*Attorney, Agent, or Firm*—Alston & Bird LLP

[57] ABSTRACT

In a compressor in which a compression mechanism incorporated in a housing is driven by a drive shaft penetrating the housing, and the compression mechanism is lubricated by mist-form lubricating oil contained in a low-pressure gas refrigerant sucked into the housing, the lubricating oil in a space is prevented from entering a bearing and deteriorating grease in the bearing. An equalizing hole is formed to allow the space to communicate with the atmosphere, the space being defined between the bearing pivotally supporting the outer end of the drive shaft on the housing and a shaft seal disposed on the inside of the bearing to seal a gap between the drive shaft and the housing.

4 Claims, 2 Drawing Sheets

COMPRESSOR

FIELD OF THE INVENTION AND RELATED ART STATEMENT

The present invention relates to a compressor mounted in an air conditioner and other machines.

One example of a scroll type compressor is shown in FIG. 2.

A housing 1 of the scroll type compressor consists of a cup-shaped body 2 and a front housing 6 fastened thereto with bolts (not shown).

A drive shaft 7 penetrates the front housing 6 in a substantially horizontal direction, and an inner-end large-diameter portion 7*a* is pivotally supported via a main bearing 9, and an outer-end small-diameter portion 7*b* is pivotally supported via a bearing 8.

A gap between the drive shaft 7 and the front housing 6 is sealed by a shaft seal 35 on the inside of the bearing 8.

The housing 1 incorporates a scroll type compression mechanism C consisting of a fixed scroll 10, an orbiting scroll 14, and other elements.

The fixed scroll 10 is provided with an end plate 11 and a spiral wrap 12 erected on the inside surface of the end plate 11, and the end plate 11 is fastened to the cup-shaped body 2 with bolts 13.

The interior of the housing 1 is partitioned by bringing the outer peripheral surface of the end plate 11 into contact with the inner peripheral surface of the cup-shaped body 2. A discharge cavity 31 is defined on the outside of the end plate 11, and a suction chamber 28 is defined on the inside of the end plate 11.

Also, a discharge port 29 is formed in the center of the end plate 11, and the discharge port 29 is opened and closed by a discharge valve 30.

The lift of the discharge valve 30 is restricted by a valve guard 32, and the base end of the discharge valve 30 and the valve guard 32 is fastened to the end plate 11 with a bolt 33.

The orbiting scroll 14 is provided with an end plate 15 and a spiral wrap 16 erected on the inside surface of the end plate 15, and the spiral wrap 16 has substantially the same shape as that of the spiral wrap 12 of the fixed scroll 10.

The orbiting scroll 14 and the fixed scroll 10 are off-centered by a predetermined distance, and engaged with each other with the phase being shifted 180 degrees as shown in FIG. 2.

A tip seal 17 is embedded in the tip end face of the spiral wrap 12, and a tip seal 18 is embedded in the tip end face of the spiral wrap 16. The tip seals 17 come into contact with the inside surface of the end plate 15, the tip seals 18 come into contact with the inside surface of the end plate 11, and the side surfaces of the spiral wraps 12 and 16 touch each other linearly, by which a plurality of compression chambers 19*a*, 19*b* are formed so as to be in substantially point symmetry with respect to the center of the spiral.

A cylindrical boss 20 projects at the center of the outside surface of the end plate 15, and a drive bush 21 is rotatably fitted in the boss 20 via an orbiting bearing 23. The drive bush 21 is formed with slide grooves 24, and an eccentric drive pin 25, projecting eccentrically at the inner end of the drive shaft 7, is slidably fitted in the slide grooves 24.

A thrust bearing 36 and an Oldham's link 26 are interposed between the outer peripheral edge of outside surface of the end plate 15 and the inner end surface of the front housing 6.

To correct the dynamic imbalance caused by the orbital motion of the orbiting scroll 14, a balance weight 27 is fixed to the drive bush 21, and a balance weight 37 is fixed to the drive shaft 7.

Thus, when the drive shaft 7 is rotated, the orbiting scroll 14 is driven via an orbiting drive mechanism consisting of the eccentric drive pin 25, slide grooves 24, drive bush 21, orbiting bearing 23, boss 20, and the like. The orbiting scroll 14 performs orbital motion along a circular orbit with an orbiting radius while the rotation thereof is checked by the Oldham's link 26.

Then, the linearly touching portion of the side surfaces of the spiral wraps 12 and 16 moves gradually toward the center of the spiral. As a result, the compression chambers 19*a*, 19*b* move toward the center of the spiral while decreasing the volume thereof.

Accordingly, a low-pressure gas refrigerant sucked into the suction chamber 28 through a suction passage 37 is introduced into the compression chambers 19*a*, 19*b* through an opening defined by the outer end of the spiral wraps 12 and 16, reaching a central chamber 22 while being compressed. From here, the refrigerant, passing through the discharge port 29, is discharged into the discharge cavity 31 by pushing to open the discharge valve 30, and flows out from this cavity through a not illustrated discharge port.

Mist-form lubricating oil contained in the low-pressure gas refrigerant sucked into the suction chamber 28 lubricates the compression mechanism C, main bearing 9, shaft seal 35, drive bush 21, orbiting bearing 23, Oldham's link 26, thrust bearing 36, and other elements.

When the above-mentioned compressor is being operated, the low-pressure gas refrigerant sucked into the suction chamber 28 and the mist-form lubricating oil contained therein pass through a seal gap of the shaft seal 35 and enter a space 38.

When the compressor is stopped, the gas refrigerant is liquefied in the space 38, and accumulates as a liquid refrigerant.

When the operation of compressor is restarted, the liquid refrigerant in the space 38 is evaporated by the temperature rise of the bearing 8. Then, the pressure in the space 38 is increased, and the lubricating oil in the space 38 intrudes into the bearing 8, so that there arises a problem in that grease in the bearing 8 is diluted and deteriorated by the lubricating oil in the space 38.

OBJECT AND SUMMARY OF THE INVENTION

The present invention was made to solve the above problem. Accordingly, the present invention provides a compressor in which a compression mechanism incorporated in a housing is driven by a drive shaft penetrating the housing, and the compression mechanism is lubricated by mist-form lubricating oil contained in a low-pressure gas refrigerant sucked into the housing, characterized in that an equalizing hole is formed to allow a space to communicate with the atmosphere, the space being defined between a bearing pivotally supporting the outer end of the drive shaft on the housing and a shaft seal disposed on the inside of the bearing to seal a gap between the drive shaft and the housing.

Also, the present invention is characterized in that the equalizing hole is open at the upper part of the space.

In the present invention, the equalizing hole is formed to allow the space to communicate with the atmosphere, the space being defined between the bearing pivotally supporting the outer end of the drive shaft on the housing and the shaft seal disposed on the inside of the bearing to seal the gap between the drive shaft and the housing, so that the pressure in this space can be prevented from increasing. Therefore, the lubricating oil in this space can be prevented from entering the bearing, so that grease in the bearing can be prevented from being diluted and deteriorated by the lubricating oil.

Also, if the equalizing hole is open at the upper part of the space, a liquid refrigerant and lubricating oil in the space can be prevented from overflowing through the equalizing hole.

DETAILED DESCRIPTION OF PREFERRED EMBODIMENTS

Figure 1:
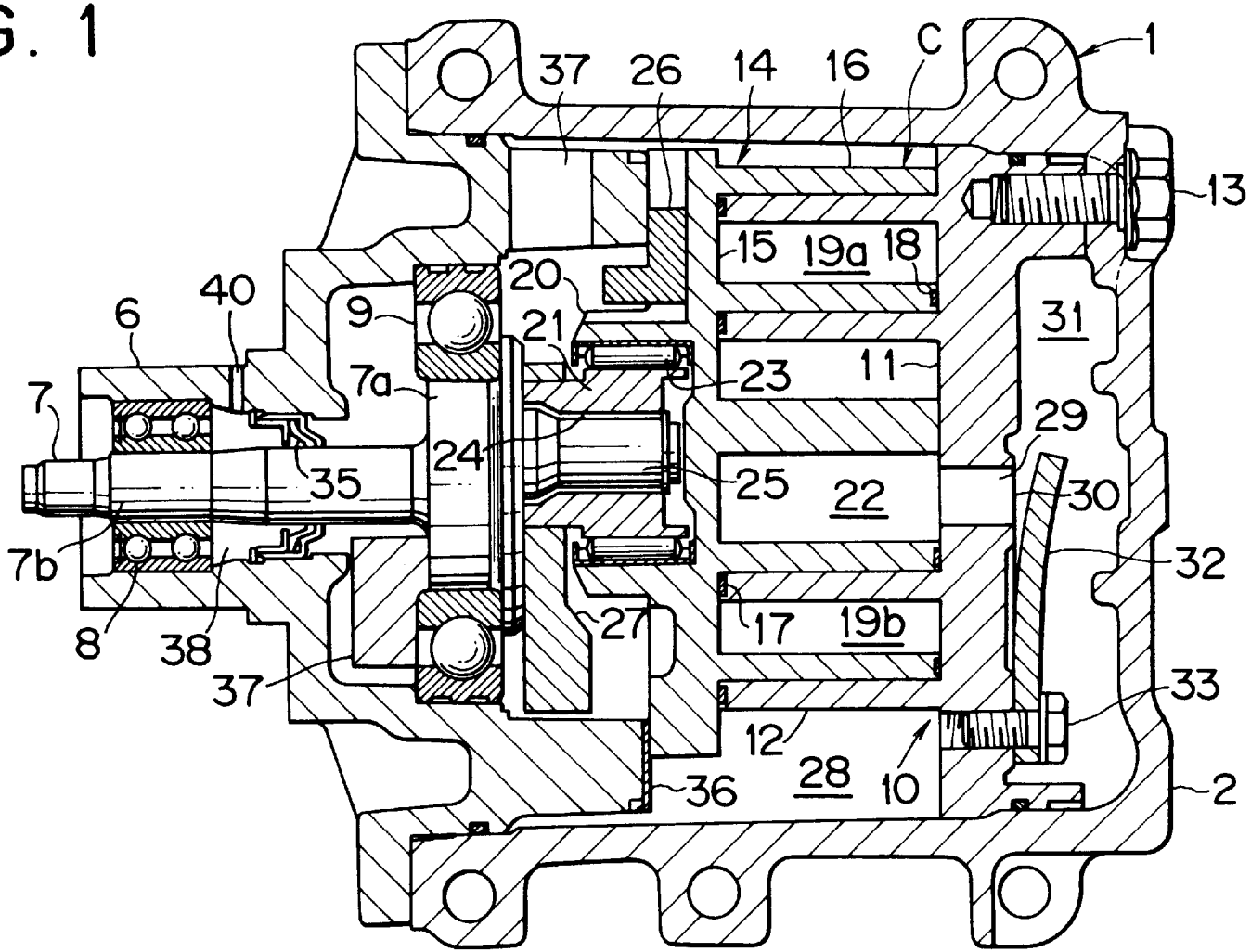
FIG. 1 is a longitudinal sectional view of a compressor in accordance with an embodiment of the present invention.

FIG. 1 shows a compressor in accordance with an embodiment of the present invention.

The space 38 is defined between the bearing 8, which pivotally supports the outer-end small-diameter portion 7*b* of the drive shaft 7, and the shaft seal 35 disposed on the inside of the bearing 8, and an equalizing hole 40 for allowing the upper part of the space 38 to communicate with the atmosphere is formed vertically so as to penetrate the front housing 6.

Figure 2:
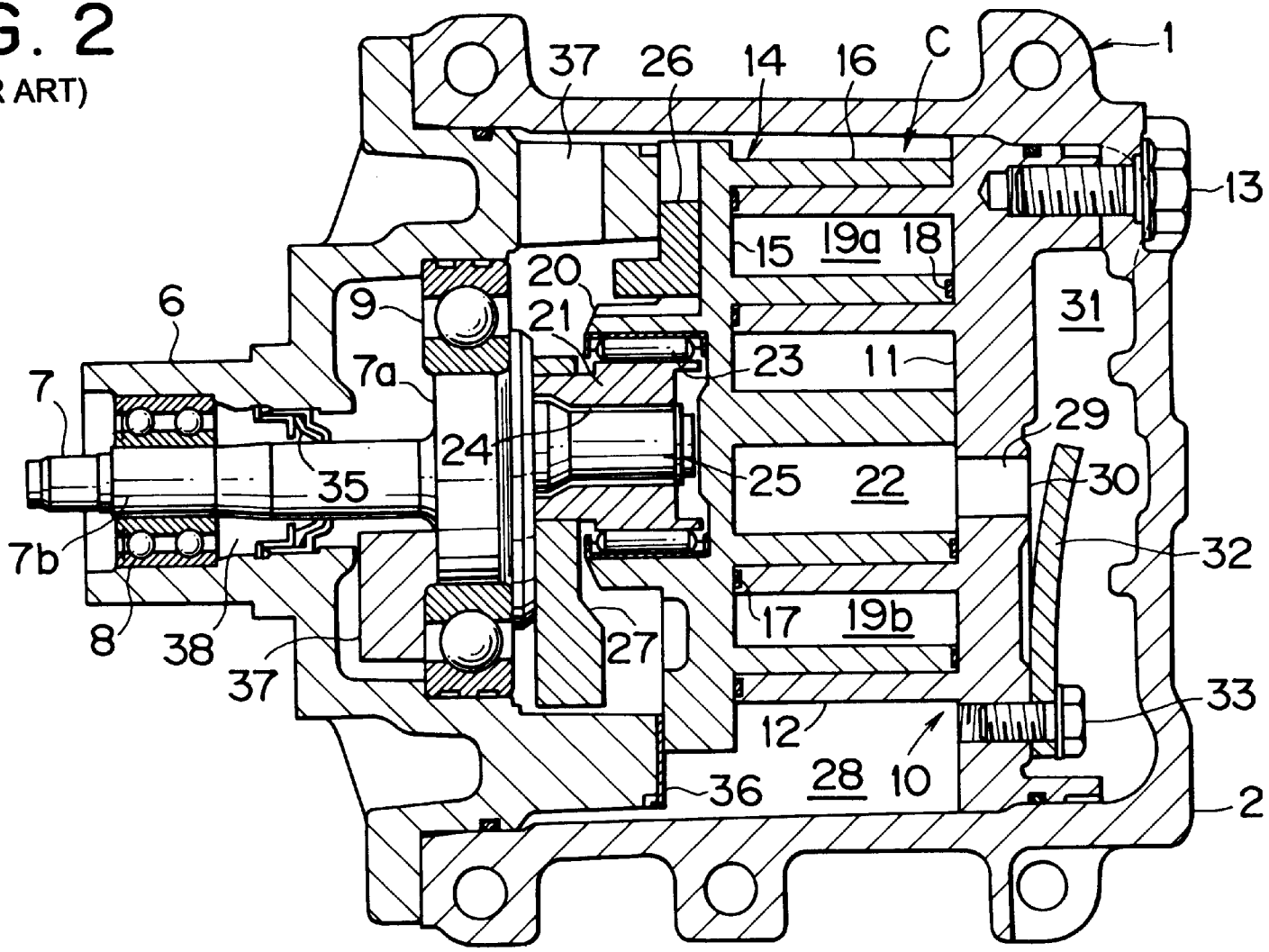
FIG. 2 (PRIOR ART)
FIG. 2 is a longitudinal sectional view of a conventional scroll type compressor.

Other configurations are the same as the conventional ones shown in FIG. 2. Therefore, the same reference numerals are applied to the corresponding elements, and the explanation thereof is omitted.

In this embodiment, when the compressor is being operated, the low-pressure gas refrigerant sucked into the suction chamber 28 and the mist-form lubricating oil contained therein pass through the seal gap of the shaft seal 35 and enter the space 38.

When the compressor is stopped, the gas refrigerant is liquefied in the space 38, and accumulates as a liquid refrigerant together with the lubricating oil. In this embodiment, since the equalizing hole 40 is open at the upper part of the space 38, the liquid refrigerant and lubricating oil do not overflow to the outside through the equalizing hole 40.

When the operation of compressor is restarted, the liquid refrigerant in the space 38 is evaporated by the temperature rise of the bearing 8. However, since the refrigerant vapor is discharged to the atmosphere through the equalizing hole 40, the pressure in the space 38 does not increase. Therefore, according to the compressor of this embodiment, the lubricating oil in the space 38 can be prevented from entering the bearing 8.

Although an example in which the present invention is applied to a scroll type compressor has been described in this embodiment, it is a matter of course that the present invention can be applied to a compressor incorporating any type of compression mechanism in the housing thereof, not limited to the scroll type compressor.

What is claimed is:

1. In a compressor in which a compression mechanism incorporated in a housing is driven by a drive shaft penetrating said housing, and said compression mechanism is lubricated by mist-form lubricating oil contained in a low-pressure gas refrigerant sucked into said housing, the improvement wherein a pressure equalizing hole is provided in said housing communicating between a space in said housing and the atmosphere, said space being defined between a bearing pivotally supporting the outer end of said drive shaft on said housing and a shaft seal disposed on the inside of said housing to seal a gap between said drive shaft and said housing.

2. A compressor according to claim 1, wherein said pressure equalizing hole is provided in said housing at a location between said bearing and said shaft seal, said location being positioned closer to said bearing than to said shaft seal.

3. A compressor comprising:

a housing having walls defining an opening;

a drive shaft extending through said opening;

a bearing mounted to said housing and supporting said shaft;

a compression mechanism positioned within said housing and connected to said shaft;

a shaft seal positioned around said shaft at a location within said housing between said bearing and said compression mechanism, said shaft seal defining a space between said seal and bearing and an equalizing hole formed in said housing and providing communication between said space and the atmosphere external to said housing.

4. The compressor of claim 3, wherein said seal, said bearing, and said shaft cooperate to define an upper part of said space proximate said bearing and a lower part of said space proximate said seal, and said passageway originates proximate to said upper part of said space.

* * * * *